US005120269A

United States Patent [19]

Endo et al.

[11] Patent Number: 5,120,269

[45] Date of Patent: Jun. 9, 1992

[54] ELECTRICAL CONNECTOR WITH TERMINAL RETAINING MEMBER

[75] Inventors: Takayoshi Endo; Sakai Yagi; Satoshi Yamada; Kimihiro Abe; Masanori Tsuji, all of Shizuoka, Japan

[73] Assignee: Yazaki Corporation, Tokyo, Japan

[21] Appl. No.: 734,974

[22] Filed: Jul. 24, 1991

[30] Foreign Application Priority Data

Aug. 1, 1990 [JP] Japan ..... 2-202463

[51] Int. Cl.[5] ..... H01R 13/436

[52] U.S. Cl. ..... 439/752; 439/595

[58] Field of Search ..... 439/595, 596, 752

[56] References Cited

U.S. PATENT DOCUMENTS 4,867,705 9/1989 Yuasa ..... 439/595

FOREIGN PATENT DOCUMENTS 55-90083 7/1980 Japan .

61-232578 10/1986 Japan .

*Primary Examiner*—Eugene F. Desmond

*Attorney, Agent, or Firm*—Sughrue, Mion, Zinn, Macpeak & Seas

[57] ABSTRACT

An electrical connector capable of achieving proper positioning and redundant retainment of terminals therein by the single operation of attaching a retaining member. The retaining member has salient portions which extend into chambers holding the terminals. Upon attachment, the retaining member is constrained to move, from a position behind the terminals, in a directin parallel to a longitudinal axis of the chambers. Accordingly, installation of the retaining piece urges the terminals into proper position and engagement with an auxiliary retaining device. In addition, the retaining member can be fixed relative to remaining portions of the connector so as to cause the salient portions thereof that extend into the chambers to provide additional retainment to the terminals.

6 Claims, 7 Drawing Sheets

ELECTRICAL CONNECTOR WITH TERMINAL RETAINING MEMBER

BACKGROUND OF THE INVENTION

1. Field of the Invention

This invention relates to an electrical connector for connecting a wire harness of an automobile, or the like. In particular, the present invention is an electrical connector having a terminal retaining member for retaining terminals received in a housing in a more secure manner.

2. Description of the Prior Art

The present Applicant has previously disclosed an electrical connector of this type in Japanese Laid-Open Patent Application No. 232578/86. Such a device is illustrated in FIGS. 10 and 11.

In this device, flexible retaining arm e is provided at each terminal receiving chamber b in connector housing a, and is adapted to be engaged with shoulder d of terminal c, when completely inserted into a proper position, so as to prevent withdrawal of terminal c from housing a. Terminal retaining member f for providing additional securement of terminal c has terminal holder plates h formed on a lower surface of holder base plate g. Terminal holder plates h are inserted into receiving chambers b through slots i on housing a. Terminal holder plates h thusly engage with stabilizer j of terminal c, so as to further prevent the withdrawal of terminal c in a redundant manner.

In the conventional connector mentioned above, as shown in FIGS. 12 and 13, terminal holder plate h is rotatable about a point P in order to be inserted into receiving chamber b. Accordingly, it also serves to urge terminal c forward as indicated by arrow Q. Therefore, when terminal c is not properly positioned as shown in FIG. 12, terminal c is caused to advance to the proper position, by rotation of holder plate h.

However, the linear stroke resulting from the angular movement of terminal holder plates h is quite small. Therefore, if terminal c is in a half inserted condition and upper surface jo of stabilizer j is disposed opposite of or to the rear of distal end ho of terminal holder plate h, as illustrated in FIG. 13, terminal c will not be properly advanced by terminal holder plate h.

SUMMARY OF THE INVENTION

In view of the above-mentioned limitations of prior art devices, an object of the invention is to provide an electric connector in which even if a terminal is not properly inserted, the terminal can be moved to a proper position by the mounting of a terminal retaining member, thereby overcoming the problem of incomplete insertion and simultaneously achieving redundant terminal retainment.

This objective has been achieved by an electrical connector design with a terminal retaining member that mounts on a connector housing having terminal receiving chambers with terminals disposed therein. The terminal retaining member is removably mounted on an outer peripheral wall of the housing. A primary retainer for engagement with the terminals when inserted into a proper position is provided in the terminal receiving chamber. Windows are provided in the outer peripheral wall of the housing. Stoppers on the retaining member are inserted through the windows so as to engage with the terminals.

The connector also has an insertion position limiting member to insure that the terminal retaining member is moved a predetermined stroke from a rear side of the window toward a front side thereof so as to insure proper position of the terminals in the housing.

In the present invention, the stoppers of the terminal retaining member may only be inserted into the rear half of the window, and subsequently must be moved toward the front side thereof. This is a result of the use of the limiting member. Therefore, if an improperly inserted terminal is present in the terminal receiving chamber, the terminal will be advanced to the proper position.

As a result, proper insertion of the terminals and the redundant retaining thereof can be accomplished, simultaneously, by one mounting operation of the terminal retaining member. Accordingly, the production of defective connectors can be minimized.

The above construction and effects will now be described by way of preferred embodiments with reference to the attached drawings.

DETAILED DESCRIPTION OF THE PREFERRED EMBODIMENTS

Figure 1:
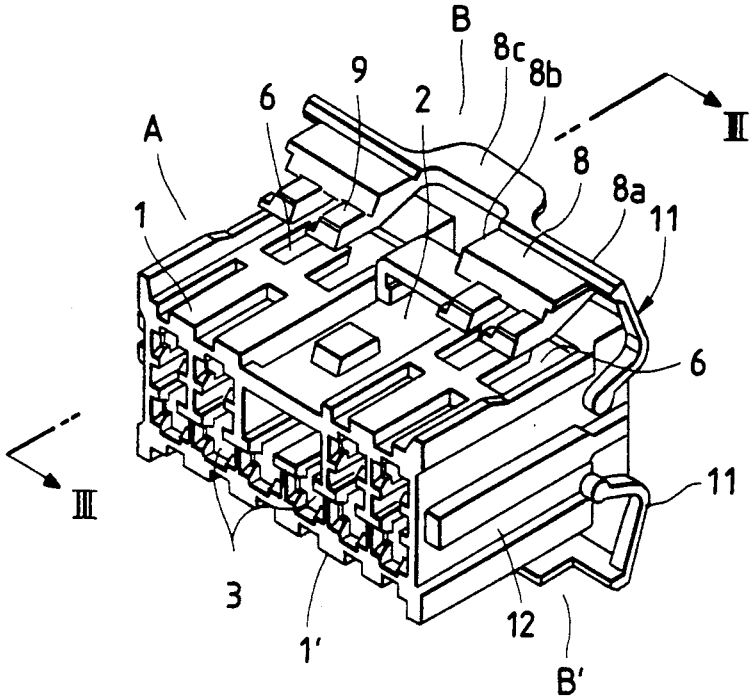
FIG. 1 is a perspective view of a first embodiment of an electric connector with a terminal retaining member of the present invention.
Figure 2:
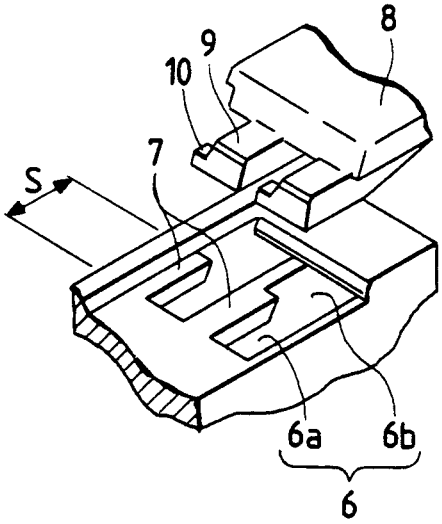
FIG. 2 is an enlarged perspective view of a portion of the first embodiment.

In FIGS. 1–4, reference character A denotes a male connector housing, and reference characters B and B′ denote terminal retaining members removably mounted respectively on upper and lower outer walls of housing A. These parts are made of an non-conductive synthetic resin material, or the like, and are of an integral construction. Female terminal C is crimp-connected, or the like, to an end of an electrically conductive wire W.

Figure 5:
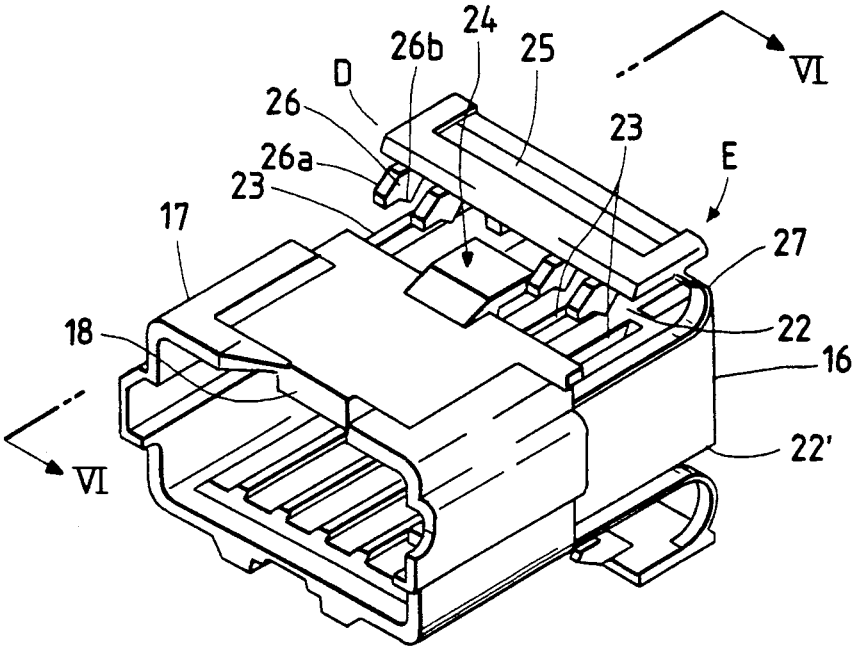
FIG. 5 is a perspective view of a second embodiment of the invention.

Male connector housing A has, at its upper outer wall 1, lock arm 2 for securement to a mating female connector housing T (see FIG. 5). The interior of male connector housing A is divided into a plurality of terminal receiving chambers 3 arranged in two (upper and lower) rows. Front stop wall 4 is provided at the front end of each receiving chamber 3, and flexible retaining arm 5 is provided at an intermediate portion of each receiving chamber 3.

Rectangular windows 6 are formed through rear half portions of upper and lower outer walls 1 and 1' of male connector housing A, and communicate with respective terminal receiving chambers 3. Baffle piece 7 is formed on one side edge of the front half of each window 6, so that the front portion thereof defines a narrow portion 6*a* whereas the rear portion defines a wide portion 6*b* (see FIG. 2).

Terminal retaining member B has stoppers 9, which are insertable into the respective windows 6, formed on a lower surface of a plate-like cover 8. Shoulder portions 8*a* project respectively from the right and left ends of cover 8 and are connected by elongated hinge straps 11 to right and left side walls 12 of male housing B, respectively.

Stopper 9 is wider than narrow portion 6*a* of window 6, and stopper 9 has projection piece 10 at one side thereof corresponding to baffle piece 7. Projection piece 10 and baffle piece 7 constitute an insertion position limiting member for stopper 9. Operating notch 8*b* for lock arm 2 is formed in a central portion of cover 8, and thumb piece 8*c* is also provided at a central portion of the cover 8 and is disposed behind operating notch 8*b*. Terminal retaining member B' is identical to terminal retaining member B except that the former has no notch 8*b* and has one additional stopper 9.

Female terminal C has an electrical contact portion C1 for contacting a male terminal (see FIG. 3) formed integrally with a front portion of base plate portion 13, and electrical connection portion C2 formed integrally with a rear portion of base plate portion 13. Retaining hole 14 is formed through base plate portion 13. Female terminal C is of a conventional design.

Figure 3:
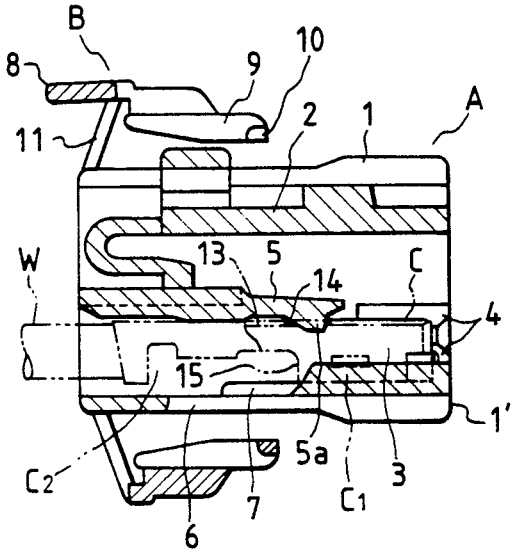
FIG. 3 is a cross-sectional view taken along the line III—III of FIG. 2.

Next, the manner of using terminal retaining member B as well as its functional operation will be described. In FIG. 3, female terminal C is preferably inserted into the proper position within terminal receiving chamber 3. The front end of electrical contact portion C1 is abutted against front stop wall 4, thereby preventing forward removal of this terminal. Projection 5*a* of flexible retaining piece 5 is engaged in retaining hole 14 in base plate portion 13 so as to achieve a primary retaining and to prevent rearward withdrawal of female terminal C. At this time, rear shoulder portion 15 of the electrical contact portion C1 can be viewed through narrow portion 6*a* of window 6.

Figure 4A:
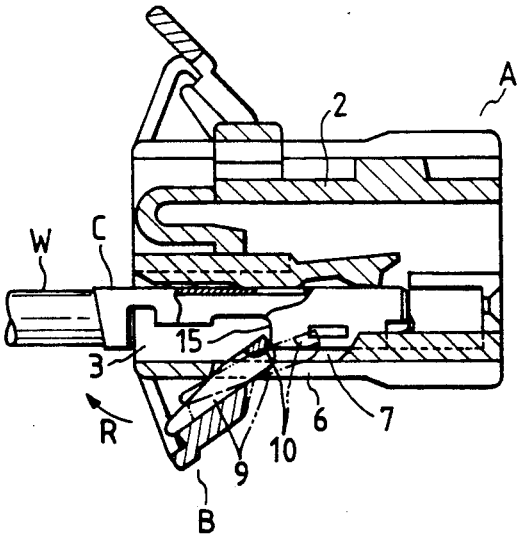
FIGS. 4*a* and 4*b* are sectional views showing the operation of the first embodiment.

As shown in FIG. 4*a*, if rear shoulder portion 15 of female terminal C is in registry with narrow portion 6*a* , that is, baffle portion 7, it can be viewed from the exterior of housing A. In the case of an improperly inserted condition, terminal retaining member B is inclined relative to window 6, and stopper 9 is inserted into terminal receiving chamber 3 through wide portion 6*b*, so that the front end of stopper 9 is abutted against rear shoulder portion 15.

Figure 4B:
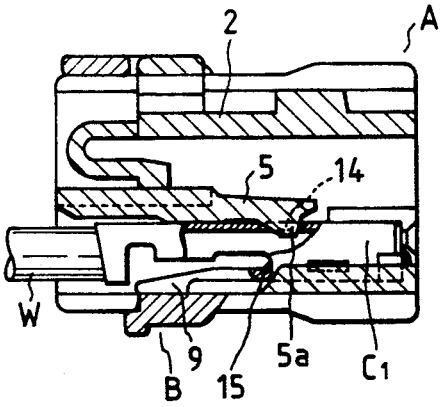

Then, terminal retaining member B is pushed forward while being rotated in a direction indicated by R in such a manner that projection piece 10 moves along the interior surface of baffle piece 7. As a result, female terminal C is cause to advance into a proper position as illustrated in FIG. 4*b*. Simultaneously, secondary retaining is achieved as illustrated in FIG. 3.

If the operator attempts to insert stopper 9 into front narrow portion 6*a* of window 6, projection piece 10 will interfere with baffle piece 7 and prevent mounting of terminal retaining member B. Accordingly, when terminal retaining member B is mounted, stopper 9 always advances a stroke distance S1 corresponding to the length of baffle piece 7. Therefore, an improperly inserted female terminal C disposed in the range of stroke S1 (see FIG. 2) will be urged to a proper position upon attachment at terminal retaining member B. As a result, proper terminal installation and redundant retainment can be accomplished simultaneously by a single mounting operation of terminal retaining member B. Accordingly, the efficiency of assembly of the connector is improved.

Figure 6:
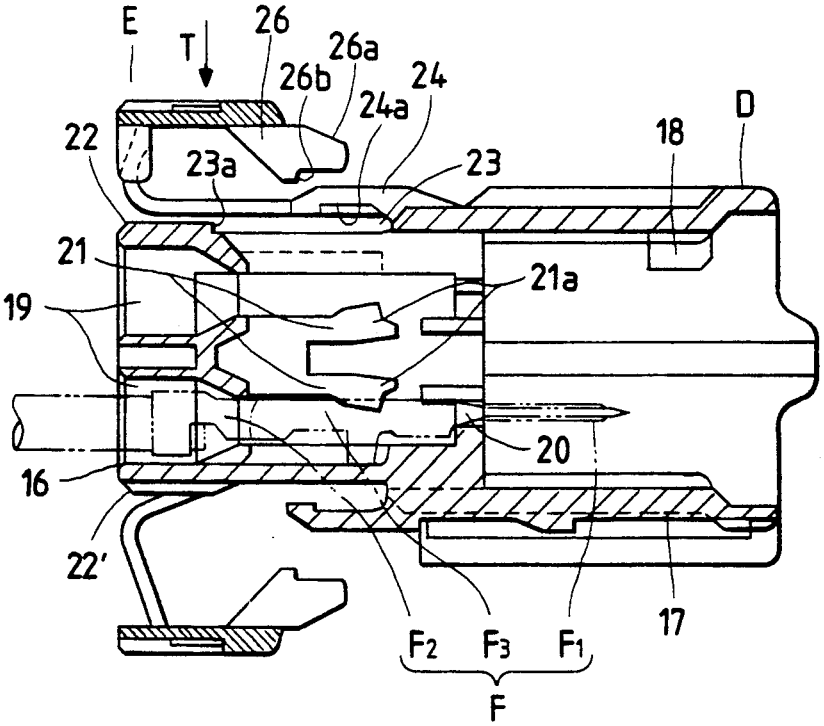
FIG. 6 is a cross-sectional view taken along the line VI—VI of FIG. 5.

In a second preferred embodiment, shown in FIGS. 5–7, female connector housing D, terminal retaining member E and male terminal F constitute the connector. Female connector housing D has hood portion 17 for receiving housing D provided at a front portion of housing body 16. Lock projection 18 for lock arm 2 is formed on hood portion 17. Each of terminal receiving chambers 19 in housing body 16 has at a front portion opening 20 of a small diameter which prevents forward removal of male terminal F. Also, flexible retaining piece 21 is provided at an intermediate portion of each terminal receiving chamber.

Similar to male connector A, of the first preferred embodiment, longitudinal windows 23 are formed through upper and lower outer walls 22 and 22, of housing body 16. Windows 23 communicate respectively with terminal receiving chambers 19. Insertion position limiting plate 24 extends from the hood portion 17 to cover the front half of window 23.

A plurality of insertion position limiting plates 24 may be provided in corresponding relation to the windows 23, respectively, but as in the preferred embodiment, a single insertion position limiting plate can be utilized. As shown in FIG. 6, lock recess 24*a* for terminal retaining member E is formed in a lower surface of insertion position limiting plate 24, and rearward withdrawal prevention lock recess 23*a* is formed in the rear edge of window 23 in opposition to limiting plate 24.

Terminal retaining member E has stoppers 26, which are insertable in respective windows 23, projecting from a lower surface of cover 25, and has the same basic construction as the above-mentioned terminal retaining member B of the first preferred embodiment. Stopper 26 has tapered guide surface 26*a* on an upper surface at the front portion thereof, and also has engaging projection 26*b* on a lower surface at the rear portion thereof which is engageable with male terminal F. Right and left sides of cover 25 are connected to a rear edge of hood portion 17 by elongated hinge straps 27.

Male terminal F has a tab-like electrical contact portion Fl at a front portion of base plate portion 28, electric wire connection portion F2 at the rear portion thereof, and tubular reinforcement portion F3 at the intermediate portion thereof. Retaining hole 29 is formed on reinforcement portion F3 of the base plate portion 28, and stabilizers 30 are formed respectively on opposite side portions of reinforcement portion F3. Male terminal F may be of a conventional design.

In this embodiment, also, as shown in FIG. 6, if male terminal F is inserted into a proper position in terminal receiving chamber 19, projection 21*a* of flexible retaining arm 21 is engaged in the retaining hole 29, thereby achieving a primary retainment. On the other hand, stoppers 9 of terminal retaining member E cannot be inserted into windows 23 in a direction of arrow T, because the front halves of windows 23 are covered with insertion position limiting plate 24.

Figure 7A:
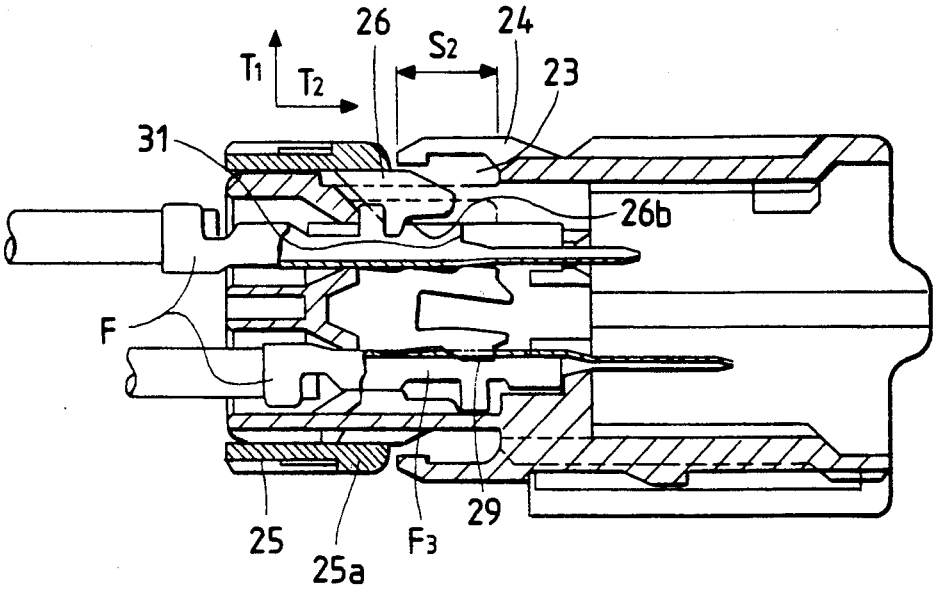
FIGS. 7*a* and 7*b* are sectional views showing the operation of the second embodiment.

Therefore, in order to mount terminal retaining member E, as indicated by arrows T1 and T2 in FIG. 7*a*, it is necessary that stopper 26 be inserted vertically downward into the rear half of the window 23 (T1), and subsequently, slid in a forward direction (T2). Accordingly, stopper 26 must be advanced a stroke distance S2 corresponding to the length of insertion position limiting plate 24.

Therefore, if male terminal F is improperly inserted so as to cause shoulder 31 of reinforcement portion F3 to be disposed at the rear half of window 23 (as shown in upper terminal receiving chamber 19 in FIG. 7*a*), engaging projection **26*b* of stopper 26 is engaged with shoulder 31, and male terminal F is advanced in response to the movement of terminal retaining member E (as shown in lower terminal receiving chamber 19**), so that male terminal F is advanced to the proper position. As a result, male terminal F is seated and redundantly retained simultaneously.

Projection **25*a* on the upper surface of cover 25 is engaged in lock recess 24*a* in the lower surface of insertion position limiting plate 24, and also the rear edge of cover 25 is engaged with the lock recess 23*a* in the rear edge of window 23, and therefore terminal retaining member E is locked. In this condition, insertion position limiting plate 24** serves as a prevention plate for preventing an upward removal of terminal retaining member E.

Figure 8:
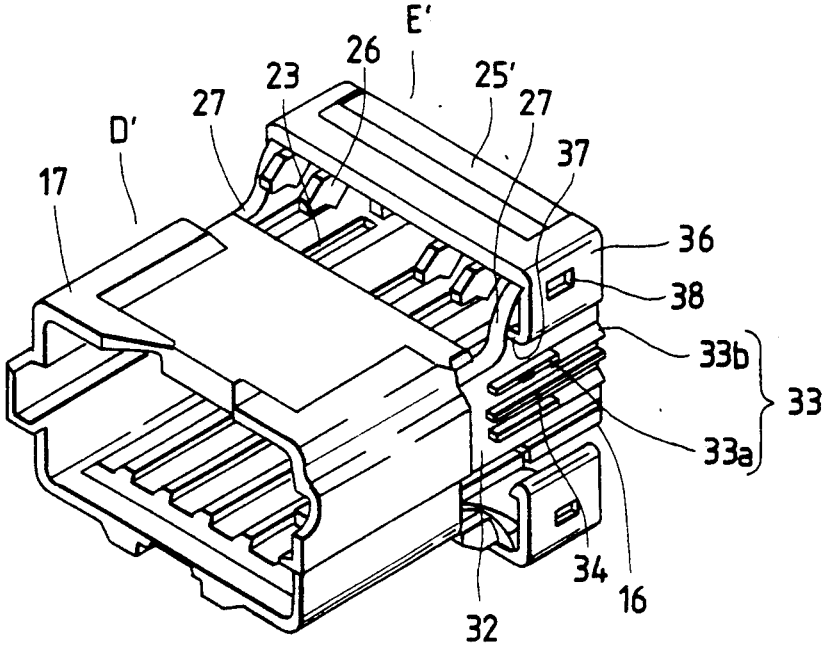
FIG. 8 is a perspective view of a third embodiment of the invention.
Figure 9:
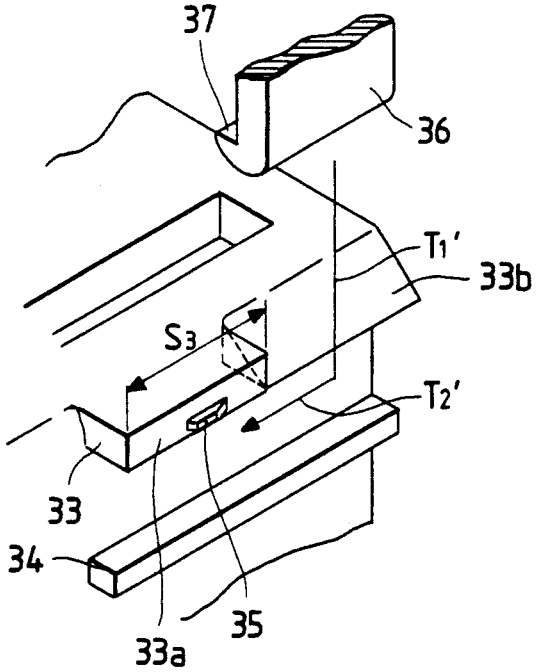
FIG. 9 is an enlarged perspective view of a portion of FIG. 8.
Figure 10:
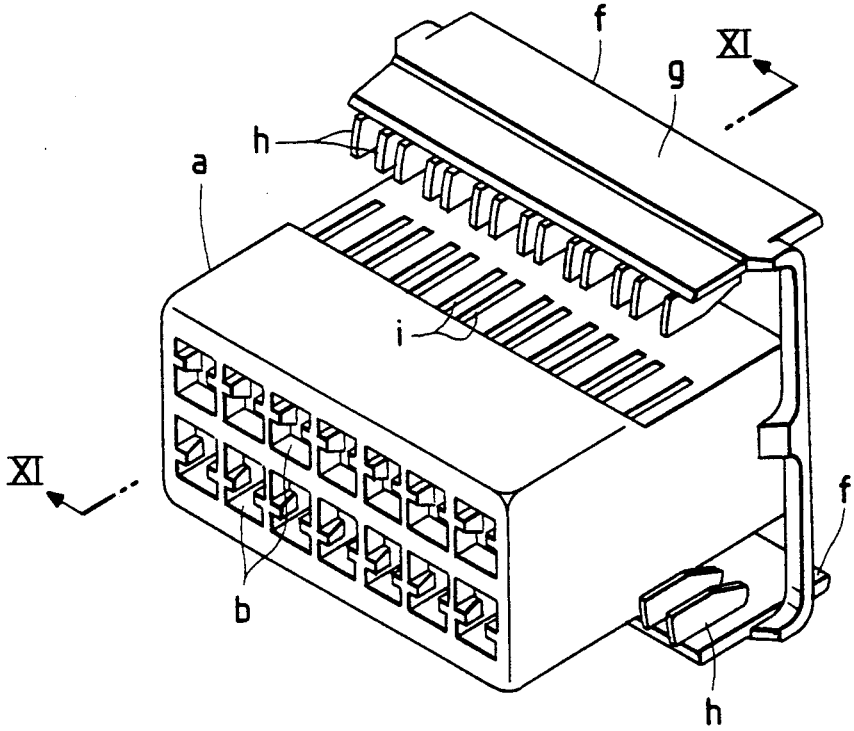
PRIOR ART FIG. 10
FIG. 10 is a perspective view of a conventional electric connector with a terminal retaining member.
Figure 11:
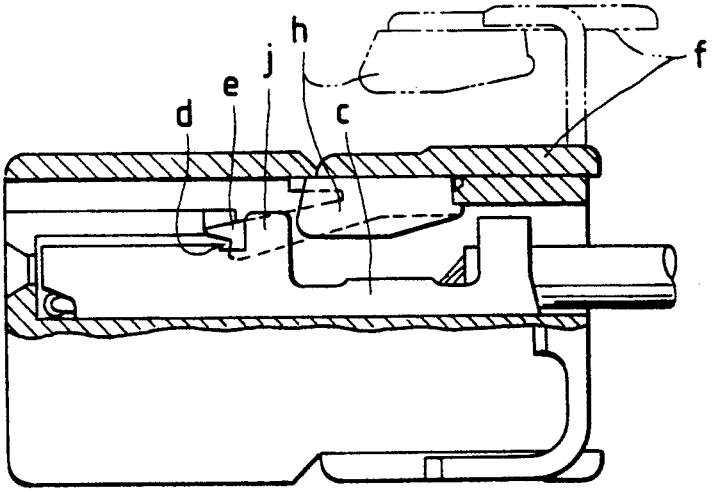
PRIOR ART FIG. 11
FIG. 11 is a cross-sectional view taken along the line XI—XI of FIG. 10.
Figure 12:
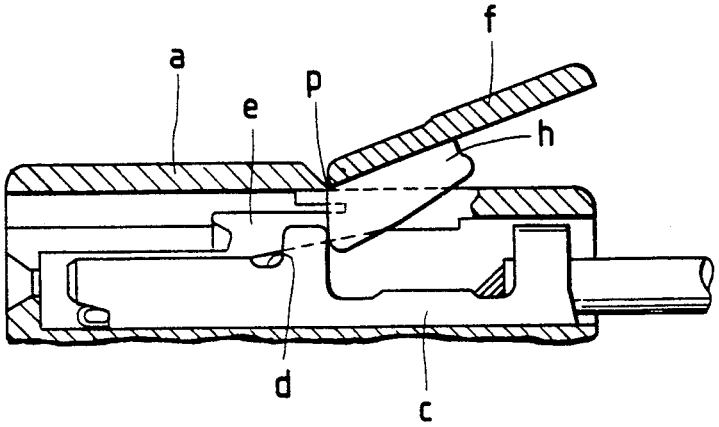
PRIOR ART FIG. 12
FIGS. 12 and 13 are views explanatory of the operation of the conventional connector.
Figure 13:
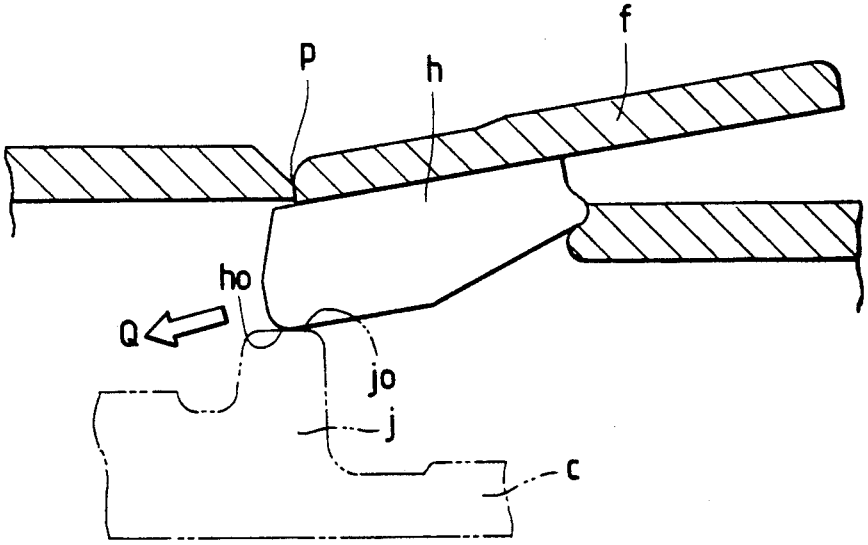
PRIOR ART FIG. 13

FIGS. 8 and 9 illustrate the third preferred embodiment of the present invention. In this embodiment, female connector housing D' is not provided with the above-mentioned insertion position limiting plate. In the alternative, two elongated insertion guide projections 33 having a locking function are formed on each of right and left side walls 32 of housing body 16, and elongated partition projection 34 is formed between the two insertion guide projections 33. The front half of elongated projection 33 defines lock projection **33*a* of a square cross-section having guide surface 35 at its side portion. The rear half thereof defines insertion guide projection 33*b* of a tapered shape. Terminal retaining member E' has leg plates 36 extending respectively from opposite sides of cover 25, Insertion piece 37 is formed on the inner surface of leg plate 36 at a lower end thereof, and lock hole 38** is formed through the central portion thereof.

In this embodiment, if the assembly personnel attempts to mount terminal retaining member E' from above at the front portion of housing body 16, insertion piece 37 at the lower end of each leg plate 36 is abutted against lock projection **33*a* at the front half of the insertion guide projection 33 so as to prevent assembly. Therefore, during assembly each leg plate 36 must be pushed down at tapered insertion guide projection 33*b* as indicated by arrow T1' while avoiding interference with lock projection 33*a*, so that insertion piece 37 is fitted in between the projections 33 and 34, and then terminal retaining member E' is advanced as indicated by arrow T2'. As a result, terminal retaining member E, is advanced a stroke distance S3 corresponding to the length of lock projection 33*a*, and leg plate 36 is locked by the engagement between lock hole 38 and guide surface 35** (see FIG. 7).

Figure 7B:
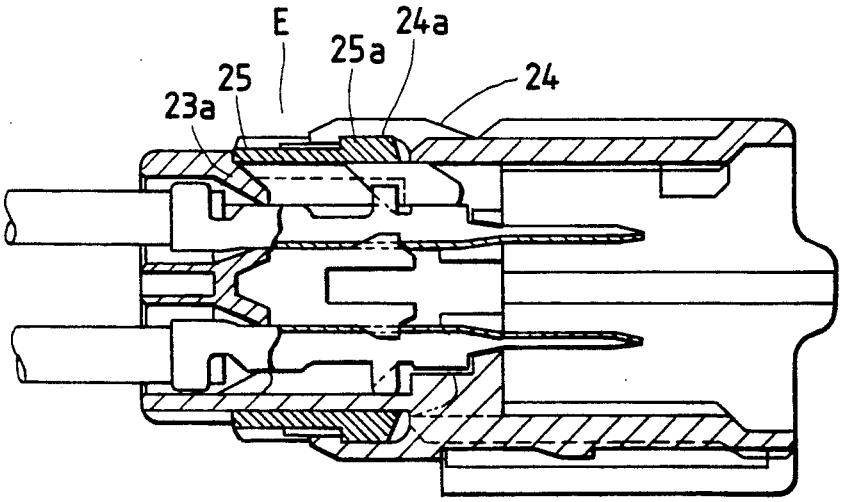

Thus, lock projection **33*a* constitutes an insertion position limiting member for terminal retaining member E' relative to window 23**. When retaining member E' is mounted on female connector housing D', redundant retainment of male terminal F and proper insertion thereof are achieved, simultaneously, as indicated in FIGS. 7*a* and 7*b*. Further, since there is no need for an insertion position prevention plate for closing window 23, the position of male terminal F can be easily viewed from the exterior of housing D'.

As described above, the electric connector of the present invention accomplishes complete insertion of the terminal and the redundant retainment thereof in a single mounting operation of the terminal retaining member. Consequently, a very reliable connector can be easily constructed. While the present invention has been described in relation to preferred embodiments it will become apparent to one skilled in the art that modifications can be made without departing from the scope of the appended claims.

What is claimed is:

1. An electrical connector, comprising:

a housing defining at least one terminal receiving chamber therein, said terminal receiving chamber being adapted to receive an electrically conductive terminal therein;

means for retaining said terminal in a predetermined position within said terminal receiving chamber including a salient portion of said retaining means that is inserted into a window of said terminal receiving chamber so as to operatively engage with said terminal; and blockage means for restricting a position of initial entry of said salient portion to a rearmost portion of the window so as to cause said salient portion to initially enter said terminal receiving chamber at a first position and in a first direction and so as to cause said salient portion to subsequently advance, in a second direction, to a second position in order to complete assembly of the connector; and wherein said first direction is one of a downwardly inclined direction and a perpendicular direction essentially perpendicular to a longitudinal axis of said terminal receiving chamber, and said first position is remote from said terminal in said predetermined position, and wherein said second direction is essentially parallel to said longitudinal axis and said second position is proximate said terminal in said predetermined position.

2. A connector as claimed in claim 1 wherein said salient portion of said retaining means extends from a body of said retaining means, said body is adapted to be removably secured to an exterior portion of said housing, said salient portion enters said terminal receiving chamber through an elongated aperture, that extends in a direction parallel to said longitudinal axis, formed through a wall of said housing that is essentially parallel to said longitudinal axis.

3. A connector as claimed in claim 2 wherein said limiting means comprises:

a first portion of said aperture that is proximate said predetermined position and a second portion of said aperture that is remote from said predetermined position, said first portion having a width that is less than a width of said salient portion of said retaining means, said second portion having a width that is at least equal to a width of said salient portion of said retaining means;

said salient portion has a channel formed thereon, said channel allows said salient portion to be advanced, in said second direction, into an area of said terminal receiving chamber that is directly below said first portion of said aperture after said salient portion enters said terminal receiving chamber through said second portion of said aperture.

4. A connector as claimed in claim 2, wherein said limiting means comprises;

means for restricting an effective length of said aperture to be less than a length of said salient portion;

a guide surface formed on said salient portion so as to allow said salient portion to be advanced in said second direction to a portion of said terminal receiving chamber directly below said restricting means only after said salient portion has entered said terminal receiving chamber in said first direction.

5. A connector as claimed in claim 2 wherein said limiting means comprises:

guide means, extending in a direction parallel to said longitudinal axis, located on an external surface of said housing;

at least one guide member extending from said body of said retaining means, said guide member being adapted for sliding engagement with said guide means so as to allow said retaining means to slide in said second direction;

means for causing an initial engagement position of said guide means and said guide member to correspond to said first position of said salient portion.

6. An electrical connector as claimed in claim 1 wherein said retaining means insures that said terminal is redundantly retained in said predetermined position by, 1) urging said terminal into engagement with an auxiliary retaining member while said salient portion moves in said second direction within said terminal receiving chamber, and 2) having means for securement of said body against movement relative to said housing.

* * * * *